US009157594B2

(12) United States Patent
Paβgang et al.

(10) Patent No.: US 9,157,594 B2
(45) Date of Patent: Oct. 13, 2015

(54) ADJUSTING DEVICE FOR HEADLIGHTS

(71) Applicant: Hella KGaA Hueck & Co., Lippstadt (DE)

(72) Inventors: Frank Paβgang, Lippstadt (DE); Kai Polenz, Geseke (DE); Dennis Tscherneck, Lippstadt (DE)

(73) Assignee: HELLA KGAA HUECK & CO., Lippstadt (DE)

( * ) Notice: Subject to any disclaimer, the term of this patent is extended or adjusted under 35 U.S.C. 154(b) by 0 days.

(21) Appl. No.: 13/722,431

(22) Filed: Dec. 20, 2012

(65) Prior Publication Data

US 2014/0177254 A1 Jun. 26, 2014

(51) Int. Cl.
*F21S 8/10* (2006.01)

(52) U.S. Cl.
CPC ..... *F21S 48/1159* (2013.01); *F21S 48/1757* (2013.01); *F21S 48/1104* (2013.01); *F21S 48/328* (2013.01)

(58) Field of Classification Search
CPC ..... B60Q 1/0683; B60Q 1/072; B60Q 1/04; B60Q 1/048; B60Q 1/10; B60Q 1/12; B60Q 1/26; F21S 48/1757; F21S 48/1159; F21S 48/1104
USPC ..... 362/515, 516, 460, 462, 529
See application file for complete search history.

(56) References Cited

U.S. PATENT DOCUMENTS 5,258,894 A * 11/1993 Bivens ..... 362/528
5,260,857 A * 11/1993 Lukkarinen et al. ..... 362/528
5,993,033 A * 11/1999 Sugimoto et al. ..... 362/515
6,450,674 B2 * 9/2002 Denley ..... 362/512
7,044,727 B2 * 5/2006 Cuellar et al. ..... 425/363
7,118,259 B2 * 10/2006 Fladhammer ..... 362/515
7,284,887 B2 * 10/2007 Fladhammer ..... 362/515
2005/0083709 A1 * 4/2005 Hendricks ..... 362/529
2008/0291690 A1 * 11/2008 Gattone et al. ..... 362/524
2013/0141930 A1 * 6/2013 Inaba ..... 362/516
2014/0094372 A1 * 4/2014 Englund et al. ..... 505/181

FOREIGN PATENT DOCUMENTS

DE 19810480 A1 * 9/1999
EP 1391347 A2 * 2/2004

OTHER PUBLICATIONS

Machine English translation of EP1391347A2.*
Machine English translation of DE19810480 to Brauburger et al.*

* cited by examiner

*Primary Examiner* — Sikha Roy
(74) *Attorney, Agent, or Firm* — Husch Blackwell LLP

(57) ABSTRACT

An adjusting device for headlights has a luminous component supported on a carrier and a linear element for angling the luminous component around a horizontal and/or vertical adjusting axis, which is acting upon said component and arranged on an adjusting point, wherein in the region of the linear element, the luminous component is supported on areas of contact opposite the carrier and/or the luminous component by way of said type of deformation element such that if an adjusting force is applied onto the areas of contact in the normal direction, the deformation element is moveable together with the luminous component along an adjusting pathway running perpendicular to the normal direction.

11 Claims, 4 Drawing Sheets

ADJUSTING DEVICE FOR HEADLIGHTS

TECHNICAL FIELD OF THE INVENTION

The invention relates to an adjusting device for headlights having a luminous component supported on a carrier and having a linear element for angling the luminous component around a horizontal and/or vertical adjusting axis which is acting onto said luminous component and arranged on an adjusting point.

BACKGROUND OF THE INVENTION

An adjusting device for headlights is disclosed in DE 102 38 792 A1, in which a luminous component, namely a reflector is adjustable around a horizontal adjusting axis by means of linear elements. The adjusting axis is formed with two separate movable support points of the luminous component to the carrier. To angle the luminous component around the horizontal adjusting axis, the linear elements, which have a threaded connection with the luminous component, are rotated around their axis such that the rotating motion of the adjusting element is converted into a longitudinal motion in the direction of adjustment. The disadvantage of the disclosed adjusting device is that it requires a relatively large number of components and a large installation space.

An adjusting device for headlights is disclosed in DE 198 10 480 A1, in which linear elements are provided for angling the luminous component around a horizontal adjusting axis. In each case, the linear elements comprise a spherical head supported in a socket retainer of the luminous component. The luminous component is angled around a horizontal axis by means of linear repositioning of the adjusting element in the direction of its axis. The disadvantage of the disclosed adjusting device is that it requires a relatively large installation space.

The object of the present invention is to upgrade an adjusting device for headlights such that a simple and functionally reliable adjustment is ensured in an installation space-conserving fashion.

To solve this object, the invention combined with the preamble of patent claim 1 is characterized in that the luminous component is supported in the region of the linear element on areas of contact opposite the carrier and/or the luminous component by way of said type of deformation element such that the deformation element is moveable together with the luminous component along an adjusting pathway running perpendicular to the normal direction (N) if an adjusting force is applied onto the areas of contact in a normal direction (N).

According to the invention, a linear element is braced on the adjusting point opposite a carrier and/or a luminous component of the headlight by way of a deformation element, which makes the co-movement transversely to the direction of adjustment possible due to its deformability or flexibility if a mechanical force is applied in the direction of the linear element. Because the longitudinal axis of the linear element does not cross an adjusting axis, a rotating motion of the luminous component relative to the stationary carrier occurs if an axial deformation force is applied onto the linear element, wherein the deformation element is co-moveable in the direction of an adjusting pathway running transversely to the axis of the linear element. Advantageously, the deformation element can be deformed without introducing any undesirable tensions. After adopting the adjusting position, the deformation element enables a sufficiently secure mount of the luminous component. Compared to traditional deformation elements made of rubber material, the deformation element according to the invention has the advantage that no material of the deformation element is flowing into the gap between the carrier and highway beam reflector during the adjustment. Said type of behavior would have the disadvantage that the linear element is unable to move along an adjusting pathway running transversely to the longitudinal axis of the latter, thus resulting in the undesirable introduction of bending moments into the luminous component and hence distorting the light image. Furthermore, the use of rubberized deformation elements would generate shearing stress in the rubber material which impairs the mobility of the rubberized deformation element in the transverse direction. Moreover, rubberized deformation elements do not guarantee a vibration-proof adjustment, meaning that the support of the luminous component would be "floating," thus requiring a separate fixation of the luminous component. The special feature of the deformation element according to the invention is that the static friction is identical or negligibly greater than the kinetic friction. In terms of the frictional effect, the deformation element acts as if the areas of contact of the solids facing each other consisted of ice material if a force is applied perpendicular to the areas of contact of the deformation element onto an adjacent solid. Correspondingly, the deformation element according to the invention has a relatively low static friction.

According to a preferred embodiment of the invention, the deformation element is designed as a bushing arranged slipped onto the linear elements and positioned between the carrier and a support ring of the linear elements or between the carrier and the luminous component. By applying an adjusting force running in the direction of the linear element, which can be brought about for example by tightening a nut which has a threaded connection with the linear element, the deformation element can be compressed in the normal direction along a normal adjusting pathway component on the one hand and co-moved in transverse direction to the adjusting force (normal direction) relative to the carrier or the luminous component on the other hand. Said sliding properties of the deformation element enable the "migration" of the adjusting point around the adjusting axis. Once the adjusting process is complete, a secure mount of the luminous component is ensured, and the relative position of the luminous component to the carrier is not changing in connection with vibrations.

According to an upgrade of the invention, the adjusting axis runs through two support points, on which structurally identical linear elements are used as those on the linear element arranged on the adjusting point. A deformation element is also allocated to the linear element in the support points. It can be structurally identical with the deformation element arranged on the adjusting point or consist of a rubberized material. Because the deformation elements of the support points are arranged in the immediate vicinity of the adjusting axis, they only need to be able to move in the longitudinal direction of the corresponding linear element on the support points.

According to an upgrade of the invention, the adjusting force on the adjusting point is generated friction-fitted by rotating a nut which has a threaded connection with the linear element. At the support point, the luminous component is mounted on the carrier by tightening a nut on the linear element.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

Figure 1:
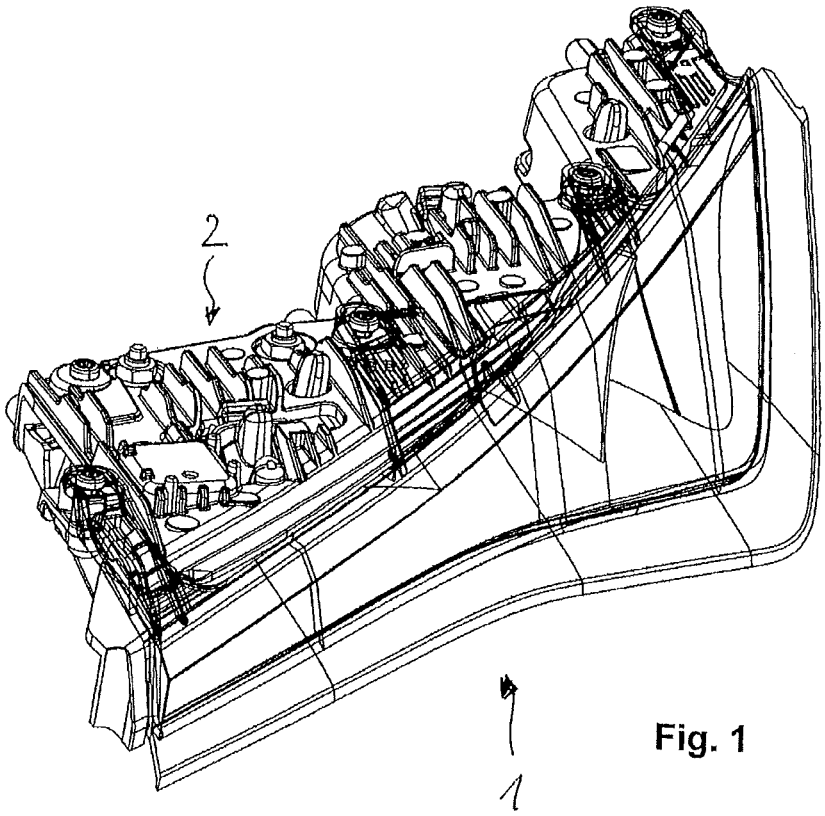
FIG. 1 shows a schematic illustration of a headlight according to the invention.
Figure 3:
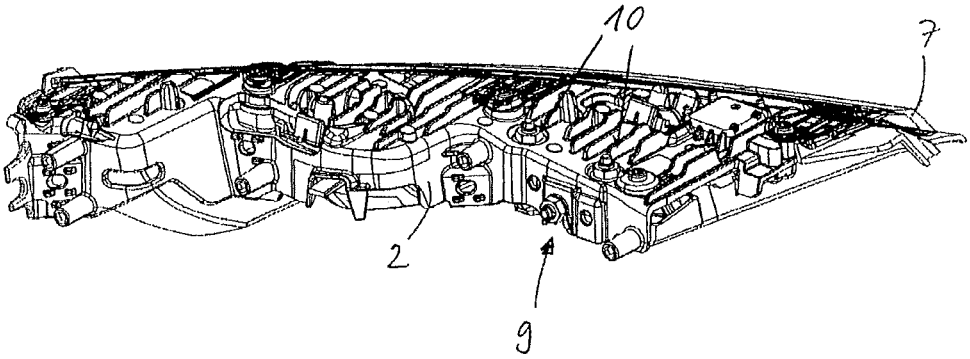
FIG. 3 shows a perspective rear view of the headlight.
Figure 2:
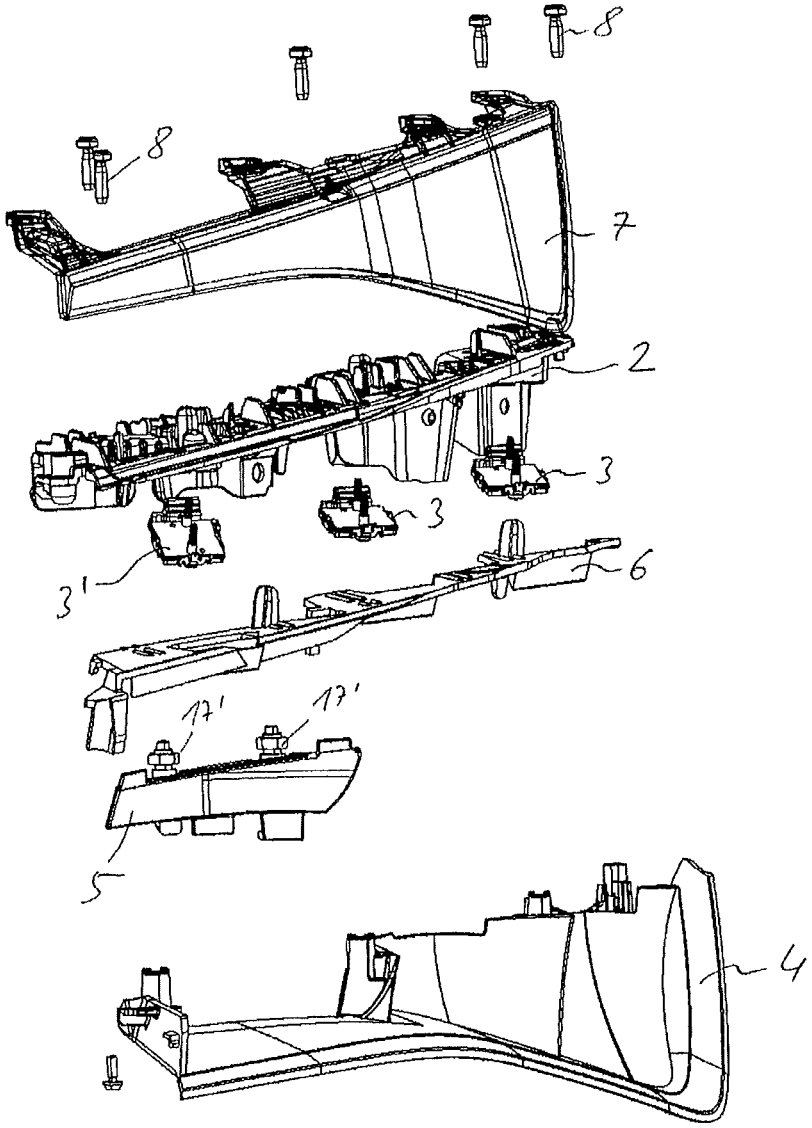
FIG. 2 shows an exploded view of the headlight having a reflector lens, a carrier, a cover and other luminous components.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

A headlight 1 according to the invention is used to generate a high beam distribution and a highway beam distribution in the frontal area of a motor vehicle.

The headlight 1 comprises a carrier 2 designed as a cooling element, from one side of which LED light sources 3, 3' are mounted. The two LED light sources 3 cooperate with a high beam reflector 4 as luminous component to generate a high beam distribution. The single LED light source 3' cooperates with a highway beam reflector 5 as luminous component to generate a highway beam distribution.

A cover plate 6 is provided between the carrier 2 and the reflectors 4, 5. At the front, the headlight 1 is covered with a transparent reflector lens 7, which can be mounted on the carrier 2 by means of corresponding fastening screws 8.

The high beam reflector 4 is mounted rigidly on the carrier 2.

The highway beam reflector 5 is mounted on the carrier 2 by way of an adjusting point 9 and two support points 10 using identical fastening means. The fastening means are formed with a linear element 12 equipped with a support ring 11, said linear element comprising a first screw thread 13 facing away from the reflector 5 and a second screw thread 14 on the side facing the reflector 5. A surface of a cylinder 15 on which a deformation element 16, 16' can be slipped on with a clearance is provided adjacent to the side of the support ring 11 facing away from the reflector 5. The smooth surface of a cylinder 15 extends between the first screw thread 13 and the support ring 11. In addition to the deformation element 16, 16', a nut 17, 17' is provided as further fastening means, which can be screwed onto the first screw thread 13 of the linear element 12, 12'.

Figure 5:
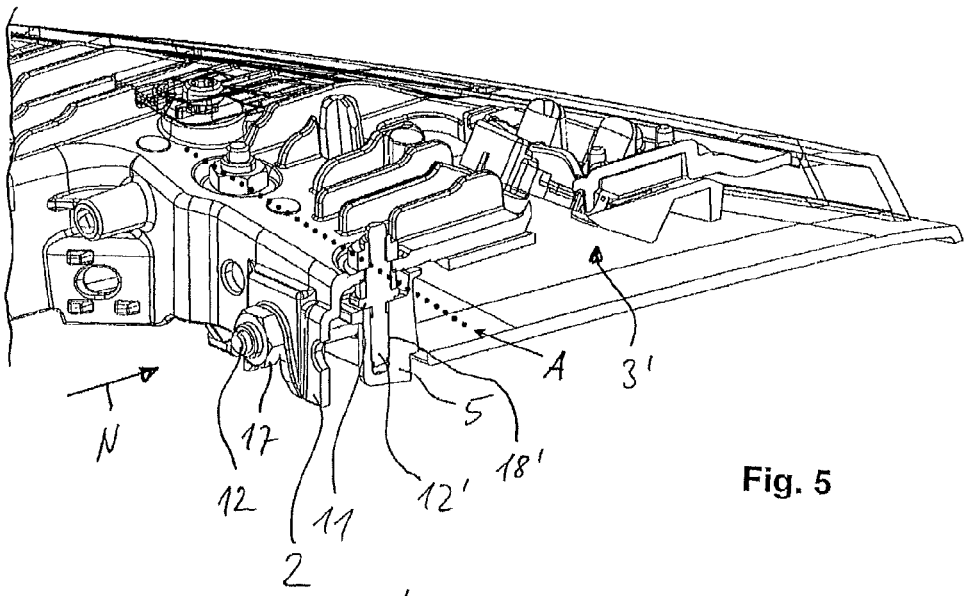
FIG. 5 shows an enlarged perspective rear view of the headlight in the region of the reflector to be adjusted with a vertical section in the region of the support point.
Figure 6:
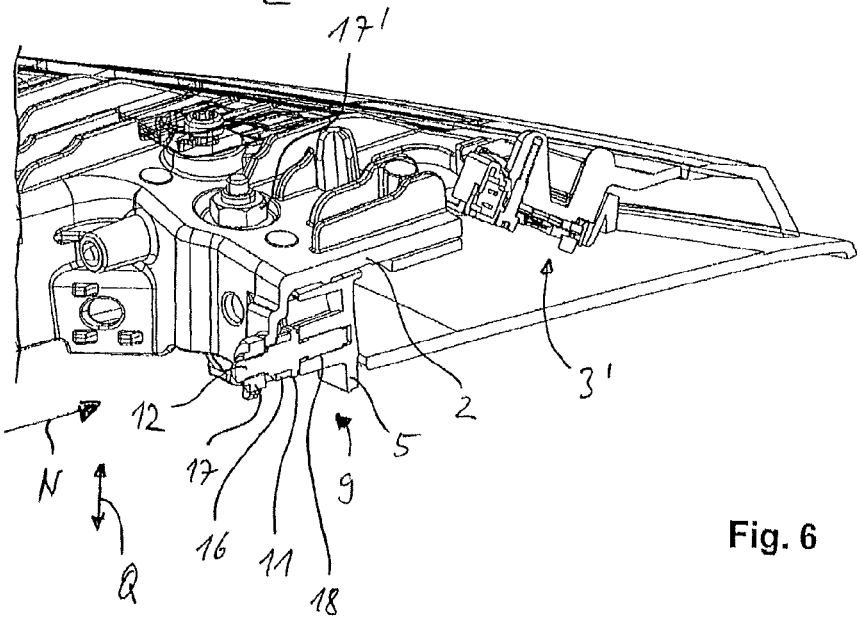
FIG. 6 shows an enlarged perspective rear view of the headlight in the region of the reflector to be adjusted with a vertical section in the region of an adjusting point.

The reflector 5 comprises a bore 18, 18' as fastening means which can be used to create a threaded connection between the linear element 12, 12' and the second screw thread 14. For this purpose, the second screw thread 14 of the linear element 12, 12' comprises a thread-forming geometry such that if the linear element 12, 12' is mounted, it cuts an internal screw thread into the bore 18, 18' of the reflector 5. As more clearly discernible from FIGS. 5 and 6, one ring side of the support ring 11 is resting against a front 19, 19' of the bores 18 and 18', respectively, while the opposing ring side of the support ring 11 serves as area of contact for the placement of a front of the deformation element 16, 16'.

An outer ring side of the deformation element 16, 16' which is provided opposite with respect to the reflector 5, rests directly on an inner surface of the carrier 2. The nut 17, 17' which has a threaded connection with the linear element 12, 12' is provided outside the carrier 2, whereby a ring side of the nut 17, 17' facing the reflector 5 exerts pressure onto the outer surface of the carrier 2 in the mounted position. The deformation element 16, 16' has a flexible or elastic design. The deformation element 16, 16' is designed as a bushing which on the one hand frontally rests on an inner surface of the carrier 2 by means of corresponding ring-shaped areas of contact and on the other hand rests on the ring side of the support ring 11 of the linear element 12, 12'. In particular the deformation element 16 allocated to the adjusting point 9 consists of a Teflon material (PTFE) such that the "migration" or angling of the adjusting point 9 in the transverse direction Q to the normal direction N around an adjusting axis A is made possible without the emergence of any undesirable tensions on the reflector 5 or the earner 2.

The adjusting axis A extends between the two support points 10 in the form of a connecting line. The angling of the reflector 5 relative to the stationary carrier 2 is made possible by the deformation elements 16', which are compressed and released on one side of the linear element 12' in the extension direction of the latter when angled. Generally, there is no motion transversely to the extension axis of the respective linear element 12' because said deformation elements 16' are located close to the adjusting axis A.

According to an alternative embodiment of the invention, said deformation elements 16' can also consist of a rubberized material, for example a silicon material.

The deformation element 16 is made of a Teflon material (PTFE) or Teflon-like synthetic material such that the deformation element 16 is compressed in the direction of the normal force on the one hand, if an adjusting force running in the normal direction N is applied onto ring-shaped areas of contact 20 of the deformation element 16 and on the other hand is moved together with the reflector 5 relative to the earner 2 in the transverse direction Q perpendicular to the adjusting axis A. The adjusting force is brought about by tightening the nut 17. Due to the fact that the axis of symmetry of the linear element 12 runs in a horizontal plane which is located below the adjusting axis A, an angling motion around the adjusting axis A is brought about by activating the nut 17 within the meaning of compressing the carrier 2 and the reflector 5 relative to each other, in which the reflector 5 is angled upward relative to the carrier 2, such that a light-dark boundary of the highway beam distribution can be set to a specified level. Consequently, the light-dark boundary can be adjusted as desired by rotating the nut 17.

The deformation element 16 allows the co-motion of a deformation element 16 along the adjusting pathway in a transverse direction Q, said deformation element having a reduced friction due to its material properties, in particular a friction comparable to the kinetic friction.

Figure 4:
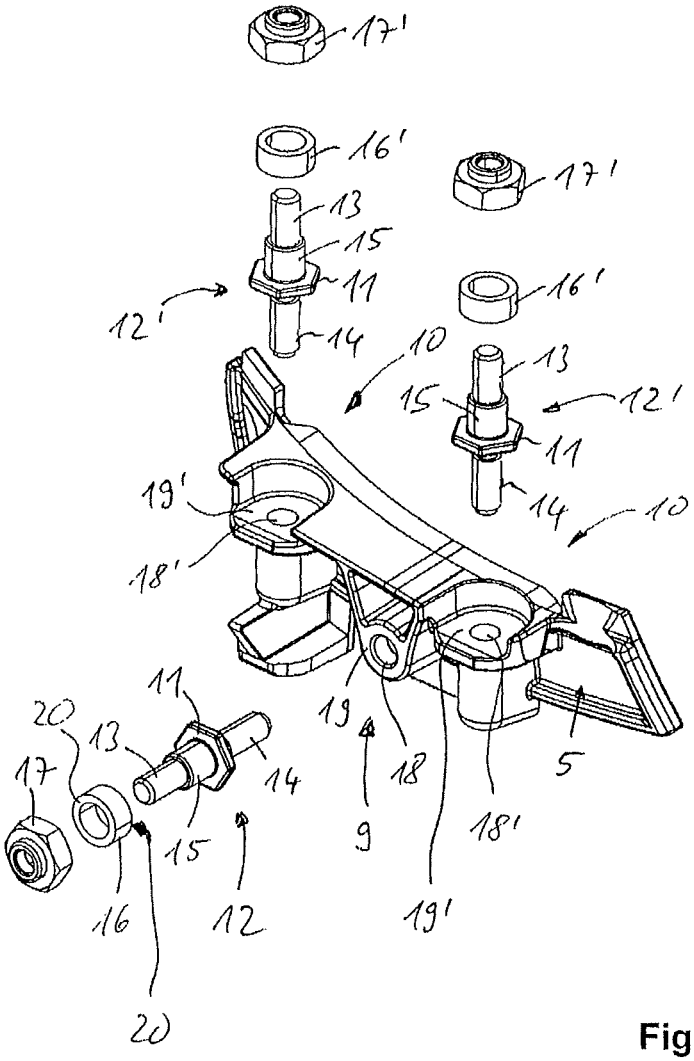
FIG. 4 shows an enlarged representation of a luminous component designed as a reflector with associated fastening and adjusting elements.

As illustrated in FIG. 4, the linear elements 12, 12' are in each case designed as locking screws which comprise the support ring 11 in a central area. The linear elements 12, 12' have a rotationally symmetrical design. The linear element 12 allocated to the adjusting point 9 essentially extends perpendicular to the linear elements 12' which are each allocated to the support points 10.

The headlight is mounted as follows. The LED light sources 3, 3' are fastened on the carrier 2. Next, the cover plate, 6, the high beam reflector 4 and the highway beam reflector 5 are mounted on the carrier 2, wherein the linear elements 12, 12' are first screwed into the corresponding bores 18, 18' to the point where the support ring 11 hits the fronts 19, 19' of the bores 18, 18'. Then the deformation elements 16, 16' are slipped onto the linear elements 12, 12' from the outside. Once the linear elements 12, 12' have been slipped into corresponding bores of the carrier 2 with their sections comprising the first screw thread 13, the nuts 17, 17' are screwed onto the first screw thread 13. Said nut 17, 17' is located outside the space which is surrounded by the carrier and the reflector lens 7 such that a basic adjustment of the highway beam distribution can be conducted before mounting additional components.

According to a not illustrated alternative embodiment, the invention can also be used for adjusting a plurality of reflectors provided with the intention of contributing to the generation of a common light distribution.

The invention can be used for any application in which the purpose is to adjust luminous components such as reflectors, light sources, light conducting elements relative to another luminous component. Within the meaning of the invention, the carrier is equally considered a luminous component.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiment, but should be defined only in accordance with the following claims appended hereto and their equivalents.

LIST OF REFERENCES

1 Headlight
2 Carrier
3 LED light source
4 High beam reflector
5 Highway beam reflector
6 Cover plate
7 Reflector lens
8 Fastening screws
9 Adjusting point
10 Support point
11 Support ring
12,12' Linear elements
13 First screw thread
14 Second screw thread
15 Surface of a cylinder
16, 16' Deformation element
17, 17' Nut
18, 18' Bore
19, 19' Front
20 Area of contact
A Adjusting axis
N Normal direction
Q Transverse direction

The invention claimed is:

1. An adjusting device for headlights, comprising:
a carrier;
a luminous component at least partially supported on said carrier by a first linear element, said first linear element for angling said luminous component around an adjusting axis, wherein a portion of said linear component acts upon said luminous component to cause said angling;
a first deformation element positioned between said luminous component and said carrier, wherein when an adjusting force is applied to said first linear element in a normal direction, said first deformation element is deformable to absorb stress caused by adjustment of said luminous component, and is thereby moveable together with said luminous component along an adjusting pathway running perpendicular to said normal direction and;
a support ring on said first linear element between said first deformation element and said luminous component, wherein said first deformation element comprises a bushing arranged on said first linear element between said carrier and said support ring.

2. The adjusting device according to claim 1, wherein said first deformation element comprises a material providing reduced friction comparable with kinetic friction during relative motion of said first deformation element to said luminous component.

3. The adjusting device according to claim 1, wherein said first deformation element has a flexible design.

4. The adjusting device according to claim 1, wherein said first deformation element includes PTFE.

5. The adjusting device according to claim 1, further comprising first and second support points by which said luminous component is mounted to said carrier with fasteners and wherein an adjusting axis is formed by a connecting line running between said first and second support points and perpendicular to said fasteners and to said first linear element on an adjusting point.

6. The adjusting device according to claim 1, wherein said first linear element comprises a locking screw having a screw thread which has a threaded connection with a nut acting on said carrier, such that said adjusting force is applied via said locking screw against said carrier.

7. The adjusting device according to claim 1, further comprising at least a second linear element and wherein said first and second linear elements are structurally identical to one another and wherein said at least a second linear element supports said luminous component with respect to said carrier at an angle generally perpendicular to the first linear element.

8. The adjusting device according to claim 1, wherein said first linear element has a threaded connection with said luminous component.

9. The adjusting device according to claim 1, wherein said luminous component comprises a reflector and further comprises an LED source allocated to said reflector, wherein said LED source is mounted on said carrier.

10. The adjusting device according to claim 1, wherein said carrier comprises a cooling element.

11. An adjusting device for headlights, comprising:
a carrier;
a luminous component at least partially supported on said carrier by a first linear element;

a first deformation element positioned between said luminous component and said carrier, wherein when an adjusting force is applied perpendicularly to said first linear element, said first deformation element is deformable to allow pivoting of said luminous component; and a support ring on said first linear element between said first deformation element and said luminous component, wherein said first deformation element comprises a bushing arranged on said first linear element between said carrier and said support ring.

* * * * *